US006787985B2

(12) United States Patent
Chen

(10) Patent No.: US 6,787,985 B2
(45) Date of Patent: Sep. 7, 2004

(54) SEALED HOUSING FOR FIELD EMISSION DISPLAY

(75) Inventor: Ga-Lane Chen, Fremont, CA (US)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/289,559

(22) Filed: Nov. 6, 2002

(65) Prior Publication Data

US 2004/0085012 A1 May 6, 2004

(51) Int. Cl.[7] ..... H01J 1/62
(52) U.S. Cl. ..... 313/495; 313/553; 313/560
(58) Field of Search ..... 313/495–497, 313/553–560, 546, 422, 309, 336, 351, 562; 445/24, 25, 31

(56) References Cited

U.S. PATENT DOCUMENTS 5,614,785 A * 3/1997 Wallace et al. ..... 313/496
5,984,748 A * 11/1999 Ritter et al. ..... 445/24
6,114,806 A * 9/2000 Itoh ..... 313/553
6,127,777 A * 10/2000 Watkins et al. ..... 313/554
6,172,457 B1 * 1/2001 Brown et al. ..... 313/496
6,541,900 B1 * 4/2003 Ando ..... 313/292
6,603,254 B1 * 8/2003 Ando ..... 313/495

FOREIGN PATENT DOCUMENTS

JP 59154738 A * 9/1984 ..... H01J/63/00

* cited by examiner

*Primary Examiner*—Nimeshkumar D. Patel
*Assistant Examiner*—German Colón
(74) *Attorney, Agent, or Firm*—Wei Te Chung

(57) ABSTRACT

A field emission display package (1) includes an anode plate (30) coated with a phosphor layer (40), a resistive buffer (60) spaced from the phosphor layer (40), a plurality of electron emitters (50) formed on the resistive buffer (60), a cathode plate (70) in contact with the resistive buffer (60), a silicon thin film (80), and a sealed housing (5). The sealed housing includes a front plate (10), a back plate (20) and a plurality of side walls (90) affixed between the front plate and the back plate so that the front plate, the back plate and the side walls define an interspace region. The front plate and the back plate are preferably made from glass. The side walls are made from an Invar-36 alloy having a coefficient of thermal expansion similar to that of the glass.

6 Claims, 2 Drawing Sheets

SEALED HOUSING FOR FIELD EMISSION DISPLAY

BACKGROUND OF THE INVENTION

1. Field of the Invention

The present invention relates to a sealed housing for a field emission display (FED), and particularly to a sealed housing having walls made from Invar alloy and Cr-doped Invar.

2. Description of Related Art

Flat panel displays have recently been developed for visually displaying information generated by computers and other electronic devices. These displays can be made lighter in weight and require less power than conventional cathode ray tube displays. One type of flat panel display is known as a cold cathode field emission display (FED).

A field emission display uses electron emissions to illuminate a cathodoluminescent display screen and generate a visual image. An individual field emission pixel typically includes a face plate wherein the display screen is formed and emitter sites are formed on a base plate. The base plate includes the circuitry and devices that control electron emission from the emitter sites.

The emitter sites and face plate are spaced apart by a small distance to stand off the voltage differential and to provide a gap for gas flow. In order to achieve reliable display operation during electron emission, a vacuum on the order of $10^{-6}$ Torr or less is required. The vacuum is formed in a sealed space contained within the field emission display.

The use of gettering materials in field emission displays to provide adequate vacuum conditions is known in the art. Referring to FIG. 2, U.S. Pat. No. 5,688,708 discloses an FED 100 which includes an anode 102 having a plurality of cathodoluminescent deposits 104, a cathode 106 including a plurality of field emitters 108, and a plurality of side members 112 which are positioned between anode 102 and cathode 106 for maintaining a predetermined spacing therebetween. The side members 112 are affixed to the anode 102 and the cathode 106 by using glass frit sealant. The inner surfaces of anode 102 and cathode 106 and side members 112 define an interspace region. The FED 100 further defines a plurality of receptacles 118 which are in communication with the interspace region. First and second getter materials 120, 122 are contained in the different receptacles, respectively. The first and second getter materials 120, 122 enhance the vacuum level by adsorption of residual gas molecules in the interspace region. However, the FED 100 takes up more space because of the plurality of receptacles 118. In addition, the protrusion of the plurality of receptacles 118 is inconvenient and must be accommodated during packaging of the display into a system, such as a lap top computer. Furthermore, the glass frit sealant between the anode 102, the cathode 106 and side members 112 can potentially fail during the lifetime of the field emission display package, because of the different coefficients of thermal expansion of the anode 102, the cathode 106, the side members 112 and the glass frits.

It is desirable to provide an improved seal for field emission display (FED) which overcomes the above problems.

SUMMARY OF THE INVENTION

An object of the present invention is to provide a sealed housing for a field emission display (FED) which provides a good vacuum seal and which has a structure strong enough to support vacuum pressure.

Another object of the present invention is to provide a sealed housing which extends the lifetime and increases the reliability of an FED contained therein.

A field emission display package in accordance with the present invention comprises an anode plate coated with a phosphor layer, a resistive buffer spaced from the phosphor layer, a plurality of electron emitters formed on the resistive buffer, a cathode plate in contact with the resistive buffer, a silicon thin film, and a sealed housing defining an interspace region. The anode plate, the phosphor layer, the resistive buffer, the electron emitters, the cathode plate and the silicon thin film are received in the interspace region.

The sealed housing comprises a front plate, a back plate and a plurality of side walls affixed to the front plate and the back plate so that the front plate, the back plate and the side walls define the inter space region. The side walls are made from alloy 36 or alloy 42. To enhance the mechanical support and vacuum condition provided, the sealed housing further comprises inner walls made from a getter material which function as a mechanical spacer and stabilizer, and which also provide a very strong gettering effect to adsorb moisture ($H_2O$), oxygen ($O_2$), carbon dioxide ($CO_2$), and other residual gases, thereby providing a longer lifetime and greater reliability of the FED.

Other objects, advantages, and novel features of the present invention will become more apparent from the following detailed description when taken in conjunction with the accompanying drawings. A copending application Ser. No. 10/277,653 filed on Oct. 21, 2002 having the same applicant and the same assignee with the instant application discloses a basis arrangement of the invention.

DETAILED DESCRIPTION OF THE INVENTION

Figure 1:
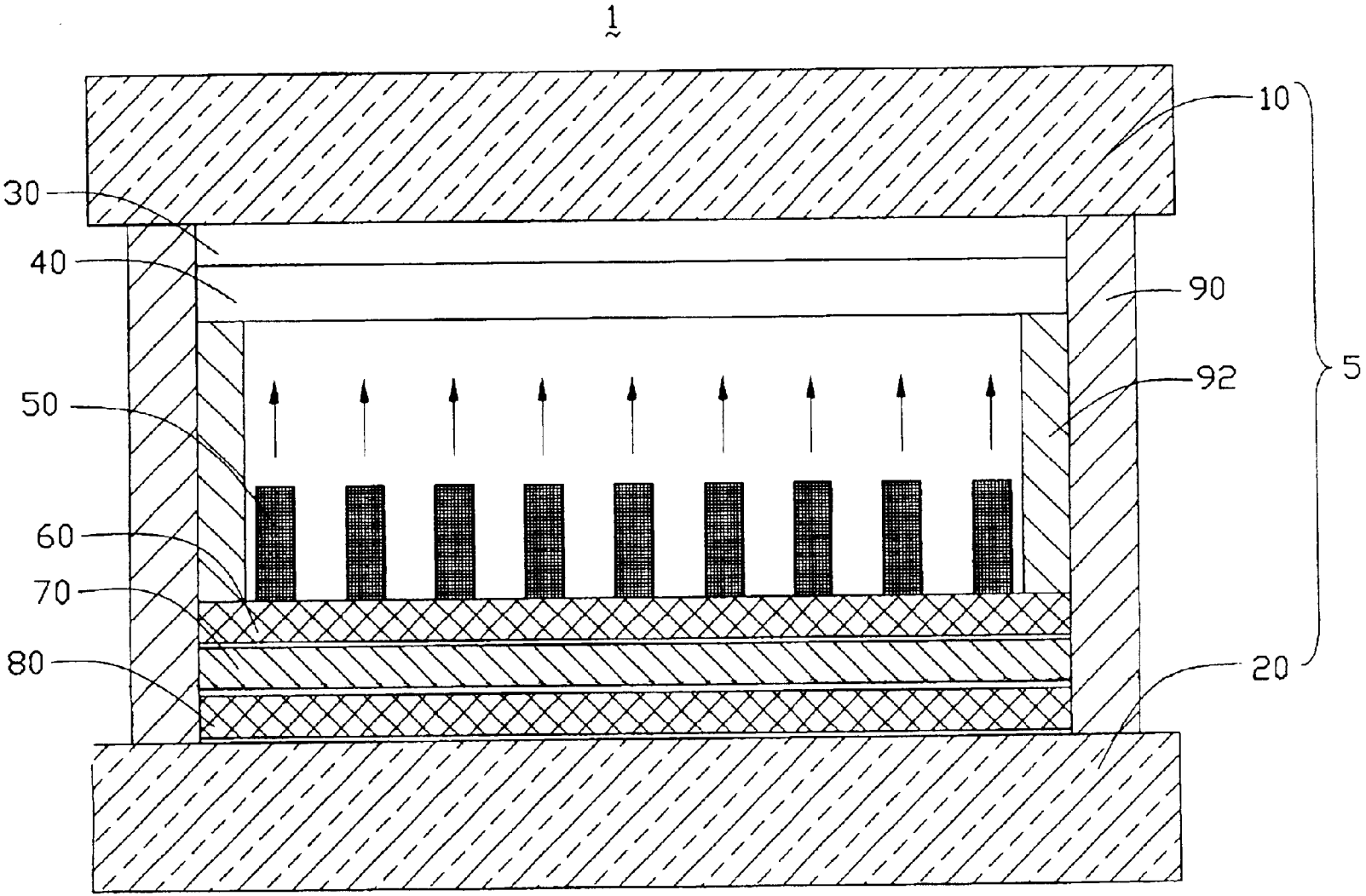
FIG. 1 is a schematic, cross-sectional view of the field emission display with a sealed housing in accordance with the present invention.
Figure 2:
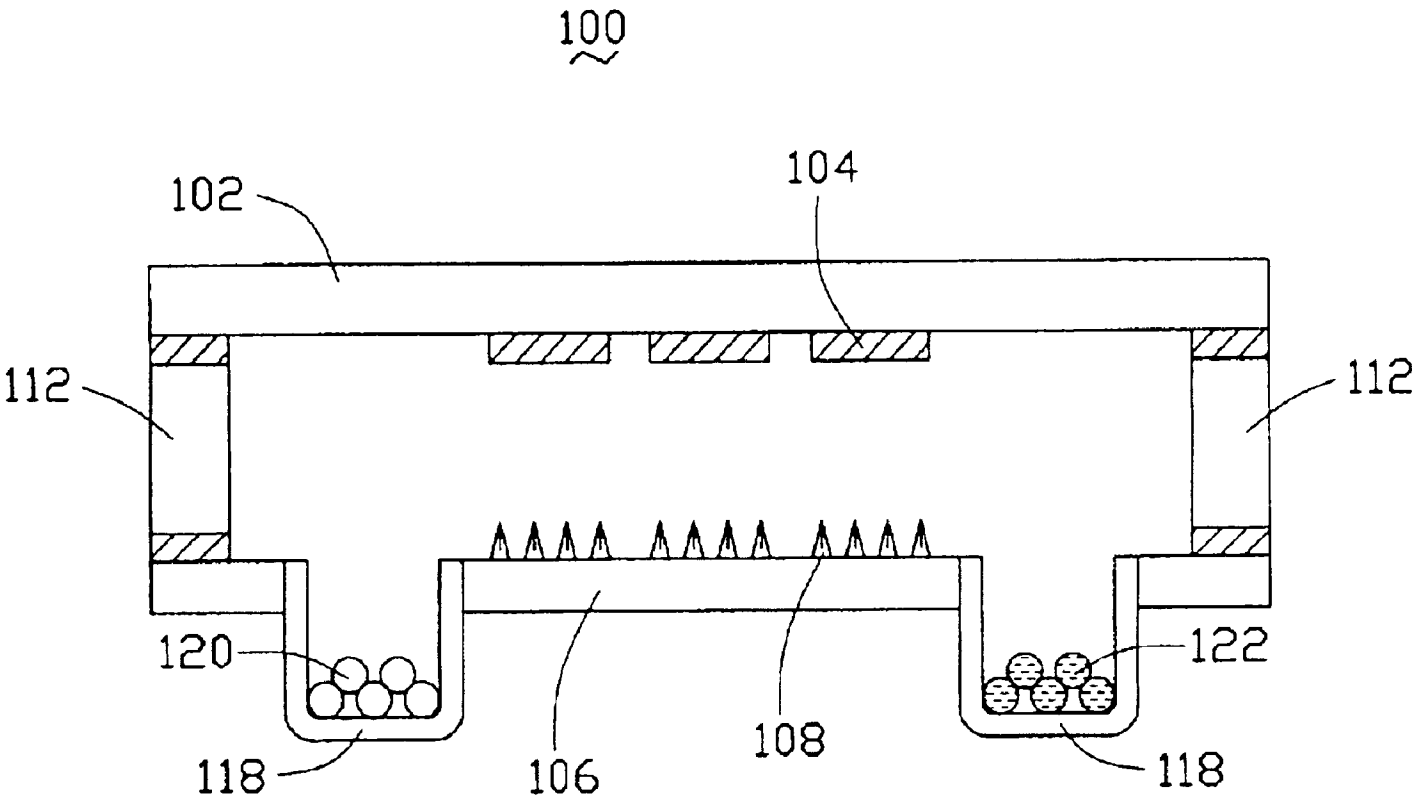
FIG. 2 (PRIOR ART)
FIG. 2 is a prior art FED with a seal.

Referring to FIG. 1, a field emission display (FED) package 1 comprises an anode plate 30 coated with a phosphor layer 40, a resistive buffer 60 spaced from the phosphor layer 40, a plurality of electron emitters 50 formed on the resistive buffer 60, a cathode plate 70 in contact with the resistive buffer 60, a silicon thin film 80, and a sealed housing 5 maintaining a vacuum in an interspace region (not labeled) defined within the sealed housing 5. The anode plate 30, the phosphor layer 40, the resistive buffer 60, the electron emitters 50, the cathode plate 70 and the silicon thin film 80 are received in the interspace region defined by the sealed housing 5.

The sealed housing 5 comprises a front plate 10, a back plate 20 and a plurality of side walls 90 affixed between the front plate 10 and the back plate 20 so that the front plate 10, the back plate 20 and the side walls 90 define the interspace region.

The front plate 10 and the back plate 20 are preferably made from glass. The side wall 90 are made from alloy 36, for example, a choice of alloy 36 having a composition with Ni 36%, Cr 0.25%, Mn 0.50%, Si 0.25%, C 0.05%, Al 0.10%, Mg 0.10%, Zr 0.10%, Ti 0.10%, P 0.02%, S 0.02 %, and Fe 62.51% by weight. The purity of the alloy 36 is preferably to have C<0.1% by weight. The tensile strength of annealed alloy 36 is 85 ksi (Max). The tensile strength of ¼ Hard alloy 36 is 90 to 115 ksi. The tensile strength of ½ Hard alloy 36 is 105 to 125 ksi. The tensile strength of Hard alloy 36 is 125 ksi (Min). alloy 36 having a coefficient of thermal expansion (CTE) similar to that of glass is required for use as the side walls 90, which provide a mechanical spacer function between the front plate 10 and the back plate 20. To enhance mechanical support of th sealed housing 5 and the condition of the vacuum, the sealed housing 5 further comprises inner walls 92 made of a getter material, which provide or mechanical strength and stability, and which are received in the inter space region and about the side walls 90. The getter material of the side wall 92 is chromium (Cr) doped nickel-iron alloy ($Cr_xNi\text{-}Fe_{1-x}$), wherein x is in range of 0.1 to 0.5. Cr has a very strong gettering effect to adsorb moisture ($H_2O$), oxygen ($O_2$), carbon dioxide ($CO_2$), and other residual gases.

The describe alloy 36 above can be substituted by alloy 42, for example, a choice of alloy 42 having a composition with Ni 39 to 41%, Cr 0.05%, Mn 0.60%, Si 0.02%, C 0.05%, Al 0.02%, Co 0.05%, P 0.02%, S 0.02%, and Fe 58.07 to 60.17% by weight. The purity of the alloy 42 is preferably to have C<0.1% by weight. The tensile strength of annealed alloy 42 is 85 ksi (Max). The tensile strength of ¼ Hard alloy 42 90 to 115 ksi. The tensile strength of ½ Hard alloy 42 is 105 to 125 ksi. The tensile strength of Hard alloy 42 is 125 ksi (Min).

The anode plate 30 is a transparent electrode formed on the front plate 10. The transparent electrode allows light to pass therethrough. The transparent electrode may comprise, for example, indium tin oxide (ITO). The phosphor layer 40 luminesces upon receiving electrons emitted by the electron emitters 50. The cathode plate 70 is made from electrically conductive material. The silicon thin film 80 is formed on the back plate 20 to provide effective contact between the back plate 20 and the cathode plate 70.

In assembly, the inner walls 92 are attached to the side walls 90. The side walls 90 are affixed to the front plate 10 and the back plate 20 using special metal-glass contact zones which are cemented with a glass sealant to hermetically seal the interspace region. The getter material forming the inner walls 92 functions as a mechanical spacer and stabilizer, and functions to adsorb gases to enhance the vacuum condition in the interspace region. The side walls 90, the front plate 10 and the back plate 20 of the sealed housing 5 have similar coefficients of thermal expansion, and the side walls 90 provide a mechanical spacer function between the front plate 10 and the back plate 20, thereby providing a longer lifetime and greater reliability of the FED.

In operation, an emitting voltage is applied between the cathode plate 70 and the anode plate 30. This causes electrons to be emitted from the electron emitters 50. The electrons are accelerated from the electron emitters 50 toward the anode plate 30, and are received by the phosphor layer 40. The phosphor layer 40 luminesces, and a display is thus produced.

Advantages of the present invention over the prior art include the following. First, the present invention provides a sealed housing for a field emission display (FED) which has an improved vacuum seal. Second, the present invention provides a sealed housing which extends the lifetime and increases the reliability of an FED contained therein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sealed housing for a field emission display, comprising:

a front plate;

a back plate opposite to and spaced apart from the front plate;

a getter material having very strong adsorption properties for moisture and air; and a plurality of side walls affixed between the front plate and the back plate so that the front plate, the back plate and the side walls define an interspace region and provide a hermetic seal for the interspace region;

wherein the side wall are made from alloy 36, and the getter material is retained in the interspace region.

2. The sealed housing as claimed in claim 1, wherein the alloy 36 has a composition with Ni 36%, Cr 0.25%, Mn 0.50%, Si 0.25%, C 0.05%, Al 0.10%, Mg 0.10%, Zr 0.10%, Ti 0.10%, P 0.02%, S 0.02%, and Fe 62.51% by weight.

3. The sealed housing as claimed in claim 2, wherein a purity of the alloy 36 has C<0.1% by weight.

4. The sealed housing as claimed in claim 3, wherein the front plate and the back plate are made from glass and have coefficients of thermal expansion similar to that of the alloy 36.

5. A field emission display, comprising:

a cathode plate;

a resistive buffer in contact with the cathode plate;

a plurality of electron emitters formed on the resistive buffer;

an anode plate coated with a phosphor layer and spaced from the resistive buffer; and a sealed housing comprising:

a front plate;

a back plate opposite to and spaced apart from the front plate; inner walls made of a getter material which function as a mechanical spacer and stabilizer; and a plurality of side walls affixed between the front plate and the back plate so that the front plate, the back plate and the side walls define an interspace region and provide a hermetic seal for the interspace region;

wherein the cathode plate, the resistive buffer, the electron emitters, the anode plate and the phosphor layer are retained in the interspace region, and the side walls are made from nickel-iron alloy, and the inner walls comprises chromium (Cr) doped nickel-iron alloy ($Cr_xNi\text{-}Fe_{1-x}$), wherein x is in range 0.1 to 0.5.

6. A sealed housing for a field emission display, comprising:

a front plate;

a back plate opposite to and spaced apart from the front plate;

a getter material having very strong adsorption properties for moisture and air; and a plurality of side walls affixed between the front plate and the back plate so that the front plate, the back plate and the side walls define an interspace region and provide a hermetic seal for the interspace region;

wherein the side walls are made from nickel-iron alloy, and the front plate and the back plate are made from glass to have the same coefficient of thermal expansion therebetween for both vision and sealing considerations.

* * * * *